US007250194B2

(12) United States Patent
Aversenti et al.

(10) Patent No.: US 7,250,194 B2
(45) Date of Patent: Jul. 31, 2007

(54) METAL SPRAYED COMPOSITE PART

(75) Inventors: Edmund Aversenti, Chester, NJ (US); Charles P. Covino, Far Hills, NJ (US)

(73) Assignee: GMIC, Corp., Linden, NJ (US)

( * ) Notice: Subject to any disclaimer, the term of this patent is extended or adjusted under 35 U.S.C. 154(b) by 0 days.

(21) Appl. No.: 11/100,748

(22) Filed: Apr. 7, 2005

(65) Prior Publication Data

US 2006/0228546 A1 Oct. 12, 2006

(51) Int. Cl.

| | |
|---|---|
| ***C23C 4/02*** | (2006.01) |
| ***C23C 4/06*** | (2006.01) |
| ***C23C 4/12*** | (2006.01) |
| ***C23C 4/14*** | (2006.01) |

(52) U.S. Cl. ..... 427/455; 427/425; 427/427; 427/427.7

(58) Field of Classification Search ..... 427/446, 427/455, 456, 424, 425, 427, 296, 421.1, 427/427.2, 427.3, 427.4, 427.7

See application file for complete search history.

(56) References Cited

U.S. PATENT DOCUMENTS 6,305,459 B1 * 10/2001 Van Reatherford et al. ... 164/46
6,849,098 B1 2/2005 Joseph et al.
2002/0176989 A1 * 11/2002 Knudsen et al. ..... 428/408
2003/0108679 A1 6/2003 Gimondo et al.

OTHER PUBLICATIONS

Argento et al., Report Brief—Design of Composite Shafts with Damping Layers for High Speed Machining Processes, Research Excellence and Economic Development Fund College of Engineering and Computer Science University of Michigan-Dearborn, Jun. 4, 2003, pp. 93-95.

Mohanty et al., Spray Deposited Metal-Carbon Fiber Reinforced Polymer Hybrid Structures, Metallurgical and Materials Transactions A, vol. 34A, Feb. 2003, pp. 421-424.

* cited by examiner

*Primary Examiner*—Michael E. Lavilla
(74) *Attorney, Agent, or Firm*—Lerner, David, Littenberg, Krumholz & Mentlik, LLP

(57) ABSTRACT

A method of making an article having both a polymeric substrate and a metallic spray deposited layer is disclosed. The coefficients of thermal expansion of the polymeric substrate and the metallic layer are preferably similar.

18 Claims, 1 Drawing Sheet

METAL SPRAYED COMPOSITE PART

BACKGROUND OF THE INVENTION

Graphite composite laminates are light weight, high strength materials useful for many different applications. In fact, it is highly desirable to construct certain objects out of such materials. For example, certain supports have been produced which are light weight and provide the proper support strength. Nevertheless, graphite composite laminates, such as epoxy impregnated with carbon/graphite fibers, are relatively expensive and, although suitable for certain applications, do not provide the exact properties typically provided by other materials such as metals.

As such, heretofore, there have been several attempts to combine metal and carbon composites to achieve certain metallic properties, while also retaining the benefits of the composites (e.g.—reduced weight). However, most of these attempts have resulted in providing a metallic core with an exterior of carbon fiber or the like. Clearly, such constructions result in an object having an exterior surface with the properties of the composite material. While this may be desirable in certain applications, it may not be in others. For example, such an object lacks the ability to be welded and may provide an object having less damage resistance. Similarly, certain metals are useful in reflecting/absorbing RF signals or the like, as well as for EMI shielding, and thus, would be better suited as the exterior material of an article.

One such attempt at depositing metal over composite materials is discussed in an article entitled "Spray Deposited Metal-Carbon Fiber Reinforced Polymer Hybrid Structures" by P. S. Mohanty and A. Argento (hereinafter referred to as "Mohanty"). Essentially, Mohanty discloses and teaches fabricating tubular structures consisting of a fiber-reinforced polymeric core having a spray deposited outer metal surface. However, Mohanty does not teach constructing the structures out of materials with like properties to ensure compatibility over a wide range of temperatures and different uses.

Therefore, a method of depositing metal over composite materials where materials with similar properties are utilized is desirable.

SUMMARY OF THE INVENTION

A first aspect in accordance with the present invention is a method of making an article. The method of this aspect includes providing a substrate being at least partially constructed of a polymeric material, the substrate having an active surface and spray depositing a first metal layer on the active surface by making at least one pass with at least one spray gun so that the metal merges with the polymeric material of the substrate. Preferably, the polymeric material of the substrate and the metal of the first metal layer have approximately the same coefficient of thermal expansion.

A second aspect in according with the present invention is an article. The article of this aspect includes a substrate at least partially constructed of a polymeric material and a first metal layer bonded with the substrate. Preferably, the polymeric material of the substrate and the metal of the first metal layer have approximately the same coefficient of thermal expansion.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

In describing the preferred embodiments of the subject matter illustrated and to be described with respect to the drawings, specific terminology will be used for the sake of clarity. However, the invention is not intended to be limited to any specific terms used herein, and it is to be understood that each specific term includes all technical equivalents which operate in a similar manner to accomplish a similar purpose.

Figure 1:
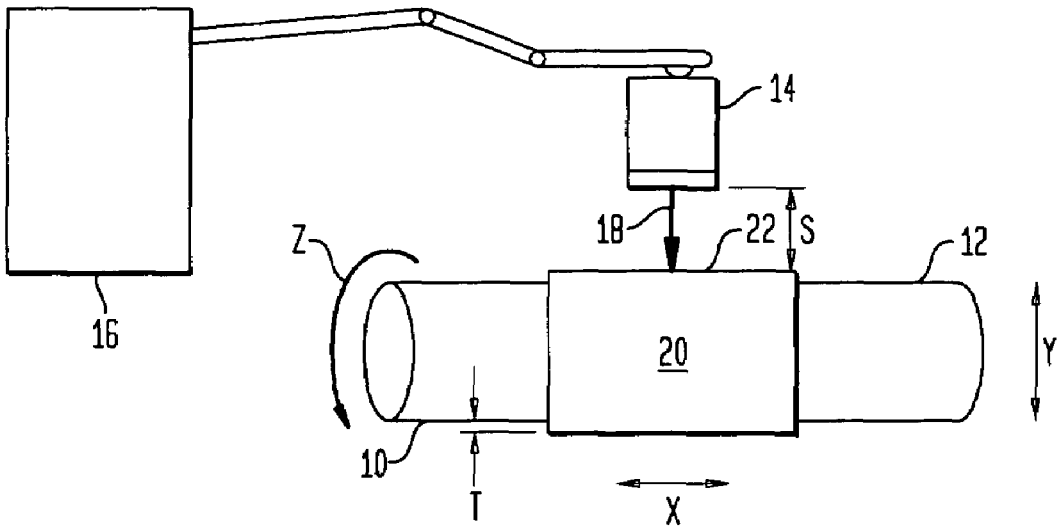
FIG. 1 is a front view depicting one stage during the formation of the first layer of a metallic material over a carbon/graphite epoxy substrate.

A process for making an article 1 in accordance with one embodiment of the present invention includes providing and using a composite substrate 10 (shown in FIG. 1). Substrate 10 includes an active surface 12 having a shape. As shown in the drawings, one preferred substrate 10 for use in accordance with the present invention is a cylindrically shaped article. However, it is contemplated that substrate 10 may be of any shape suitable for forming an article of a similar shape. Similarly, while a preferred substrate 10 is constructed of a carbon/graphite fiber and epoxy combination, other materials are suitable for constructing substrate 10. For example, it is contemplated to utilize composite materials having required structural properties, such as polymeric materials impregnated with carbon fibers or the like. More particularly, in certain preferred embodiments, the composite materials may be fibers made of glass, carbon/graphite or webbing that have, as a binding agent, resins including polyester, vinylester, bismaleimide (BMI), and as mentioned above, epoxy. Although substrate 10 is depicted in the figures as a solid, unitary body, it may incorporate internal structures such as hollow spaces, reinforcing members such as metal bars. For example, the cylindrical substrate shown in the figures may include a hollow bore running down its center in other embodiments. Similarly, any carbon/graphite material or the like situated within the epoxy or polymeric material may be situated in various configurations. Finally, substrate 10 may be formed through any conventional process. For example, high-temperature epoxy composite tooling compounds can be cast to shape using a master tool (not shown). Additionally, readily machinable stock materials may be machined to shape using conventional methods such as numerically controlled machining methods to form the substrate.

In certain preferred embodiments of the method, as shown in FIG. 1, substrate 10 is supported by a structure (not shown) capable of imparting motion to the article. For example, as indicated by arrows X, Y and Z, substrate 10 may be translated, raised/lowered and rotated with respect to the other components used in the method. This may aid in the application of metal sprayed onto active surface 12, and will be discussed more fully below. It is contemplated that the structure for imparting motion to substrate 10 may be controlled by any means, including electronic controllers and robotic technology, as well as through manual operation. For example, in the case of a cylindrical substrate 10, a lathe or similar device can be utilized to impart rotational (direction of arrow Z) motion thereto. However, it is contemplated that preferred methods in accordance with the present invention include both moving substrate 10 and a spray gun (discussed more fully below) at the same time.

The process further includes the step of spray depositing a metallic layer over the aforementioned substrate 10. As described in greater detail in commonly assigned U.S. Pat. Nos. 5,817,267 and 6,447,704, as well as commonly assigned and currently pending U.S. patent application Ser. No. 11/003,715 and U.S. patent application entitled "Combination High Density/Low Density Layers", the disclosures of which are all hereby incorporated by reference herein, spray depositing methods are well known to those of ordinary skill in the art. In accordance with the present invention, any spray depositing method may be utilized. Similarly, any spray gun suited for spraying metal can be utilized. While the above noted patents and patent applications are directed to spraying up a matrix to create a large mold or the like, it is contemplated that similar technology can be employed to spray deposit a metallic layer in accordance with the present invention.

For example, as described in the aforementioned '267 patent, a layer of metal can be sprayed upon a surface by spraying droplets of molten metal using a thermal spray gun, such as a plasma spray gun or arc spray gun onto an active surface of a matrix. Such spraying can be used to build up the metal to a substantial thickness, on the order of approximately one-quarter inch (6 mm) or more. It is envisioned that the metallic layers of the present invention will be somewhat less than that value, but may be of any thickness. During the deposition process discussed in the '267 patent, the spray gun is moved relative to the matrix so that the spray gun passes back and forth over the surface of the matrix in a movement direction and so that the spray gun shifts in a step direction transverse to the movement direction between passes. Thus, during at least some successive passes, metal is deposited on the same region of the matrix from two different spray directions in a "crisscross" pattern. The resulting shells/molds have substantial strength and good conformity with the active surface of the matrix to provide a faithful reproduction of the matrix shape. Although the '267 patent is not limited by any theory of operation, it is believed that deposition of the metal in different spray directions can produce an interwoven pattern of metal droplets and/or metal grains in the deposited shell, and that this produces a stronger, generally better shell.

The method of the present invention may use a similar metal spraying method, albeit to create a part that may be of a lesser scale. As is shown in FIG. 1, a thermal spray gun 14 linked to a conventional industrial robot 16 is used to spray deposit molten metal onto substrate 10. Thermal spray gun 14 may be a conventional plasma spray gun or an arc spray gun. For example, a typical spray gun such as that sold under the designation Model BP400 Arc Spray System by Miller Thermal, Inc. of Appleton, Wis. is arranged to apply an electrical potential to strike an arc between a pair of wires and to feed the wires continually into the arc while blowing a stream of a compressed gas through the arc. The stream carries a spray of metal droplets formed from the molten wire at a high velocity in a relatively narrow pattern extending from the front of the gun so that the droplets move principally in a spray direction 18. The sprayed metal droplets impinge on active surface 12 of substrate 10 and deposit as a first layer 20 having an exterior surface 22, which preferably conforms to the shape of active surface 12. First layer 20 has a thickness direction T generally normal to active surface 12 of substrate 10. The layer also preferably completely wraps around substrate 10, along active surface 12. Thus, layer 20 preferably wraps around and encompasses substrate 10 along any portion of its length, preferably a majority of its length.

It is noted that as mentioned above substrate 10 may be any shape. Thus, while layer 20 may wrap around the cylindrical substrate shown in the drawings, other embodiments may not include such a configuration. For example, a substrate having a relatively flat square shape may be employed in certain embodiments. Such a substrate may only have metal sprayed onto one side or both sides. Nevertheless, it is envisioned that the layer would not be required to wrap completely around the substrate.

A non-oxidizing gas such as nitrogen may be used as the gas in spraying and may be applied as a gas blanket over the area being sprayed. The use of such a non-oxidizing blanket minimizes oxidation of the metal during the process and promotes bonding of newly-sprayed metal to previously-sprayed metal.

Preferably, the robot maintains spray gun 14 at a preselected standoff distance or spacing S from the substrate and from the deposited layer. The standoff distance will depend upon the spray conditions and the particular head employed, but most typically, in accordance with the present invention, is about 6-10 inches. As the metal is sprayed from spray gun 14, robot 16 moves the spray gun head 14 in a sweeping pattern over the active surface 12 of the substrate. Desirably, the robot moves gun 14 in a movement direction as, for example, depicted by arrow X of FIG. 1. At the same time, the aforementioned device for imparting motion to substrate 10 may also move the substrate. For example, in certain embodiments, gun 14 may move to the left and right, as depicted by arrow X, while cylindrical substrate 10 is rotated by a lathe or the like, as depicted by arrow Z. This clearly would allow the substrate to become encompassed by layer 20. However, this may be different in other embodiments. The robot generally situates spray gun 14 so that spray direction 18 is at a ninety degree angle with respect to active surface 12 of substrate 10. The "splat" or pattern of metal droplets hitting exterior surface 22 is assured substantially equal distribution when the spray direction 18 is situated at this ninety degree orientation with respect to active surface 12, something that is clearly desired in order to create a uniform first layer 20. However, it is contemplated that spray gun 14 may be situated so that spray direction 18 is at various angles, in certain situations, in order to more uniformly spray the metallic droplets. For example, active surfaces 12 of substrates of other embodiments may include severe or deep undulations that may require an angled spray direction 18 to properly coat the surface with metal. Nevertheless, the process of spraying the first layer 20 is continued until a desired thickness is achieved. For example, in certain embodiments, spray gun passes are made until thickness T is approximately 0.040-0.060 inches at every point over the entire area of first layer 20. However, it is contemplated to provide a first layer 20 that is any thickness desired.

The material used to form first layer 20 is selected for compatibility with the material of substrate 10. More particularly, it is desired to select a material that includes, among other properties, a similar coefficient of thermal expansion ("CTE") to that of substrate 10. As the material of first layer 20 will ultimately substantially encompass substrate 10 in certain embodiments, it is desired to provide materials with like CTEs. This ensures that at high or low temperatures, both substrate 10 and first layer 20 expand at the same rate. Thus, damage caused by non-uniform expansion is avoided. Merely by way of example, a preferred construction in accordance with the present invention will include a substrate being constructed of an epoxy having carbon/graphite embedded fibers and a first layer being constructed of an alloy having about 36% nickel, sold under the commercial designation INVAR® (a nickel/iron alloy containing approximately 30-42% by weight nickel). In this construction, both substrate 10 and first layer 20 include materials which have relatively low CTEs. However, it is clearly envisioned that other embodiments may include different materials.

Prior to the spraying of first layer 20, substrate 10 may require some preparation, in order to allow for a proper bond to be formed with first layer 20. For example, it is preferable to provide a substrate 10 having a roughened active surface 12. To achieve such a roughened surface, it may be necessary to perform a roughening procedure. In certain embodiments, active surface 12 may be subjected to a sandblasting technique or the like. This sandblasting allows for the surface to be roughened to any desired amount of roughness, thereby providing small pockets for capturing at least portions of the metal droplets sprayed thereon. However, it is contemplated that other roughening techniques may be employed to properly prepare active surface 12 for bonding with first layer 20. For example, in other embodiments, glass beads, walnut shells, or the like may be impinged upon active surface 12 in order to perform a tightly controlled surface roughening. Additionally, it is contemplated that in addition to roughening techniques, any other adhesion promoting technique may be utilized.

Figure 2:
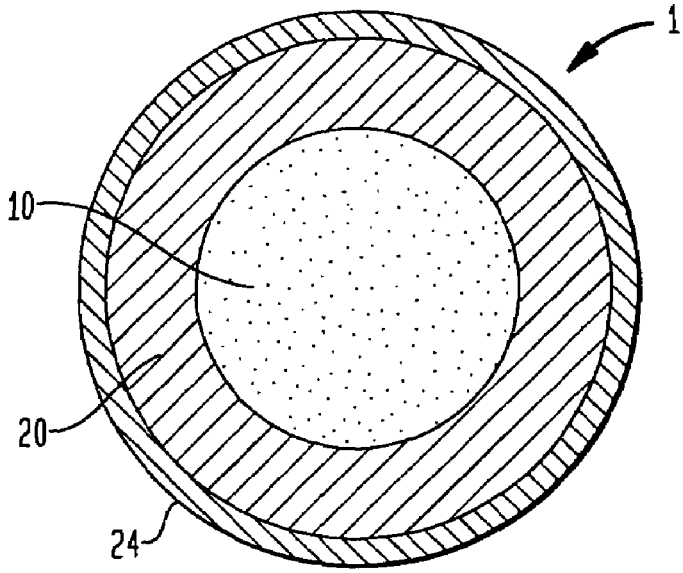
FIG. 2 is a cross sectional view of a finished article made in accordance with the present invention.

Further, subsequent to spray depositing first layer 20, an additional layer of metal or the like may be sprayed as second layer 24 (best shown in FIG. 2). This layer is preferably constructed of thin or thick layers of nickel, aluminum, stainless steel, silver, gold, copper, or any metal suitable for being polished to provide a reflective surface. It is also contemplated to construct second layer 24 of combinations of such metals. The method of spraying second layer 24 is typically similar to the above discussed spraying of first layer 20. However, it is contemplated that different spray guns may be necessary depending upon the specific type of material used to construct second layer 24. Alternatively, it is contemplated to provide second layer 24 by plating techniques, such as electroplating. The thickness of second layer 24 may be any amount, but preferably on the order of approximately 0.0015 inches. Finally, subsequent to the spraying of second layer 24, a polishing step may be performed to provide the desired reflectivity for the surface. Such polishing steps are well known in the art to those of ordinary skill. For example, a pit-free deposition that offers a finish as low as 8-10 microfinish can be employed. Further, instead of performing a traditional polishing step, article 1 may be lapped. Lapping is a well known computer controlled way of providing a final finish on a surface. Such a technique is useful for providing an article 1, such a cylinder, that is required to have tight dimensions and concentricity.

The completed article 1, the cross section of which is shown in FIG. 2, can be used in many different operations. As mentioned above, the similarity of the CTEs of each of the materials utilized provides an article 1 that has different materials that will remain bonded together throughout a wide range of temperatures. Article 1 also retains certain properties of each of the materials. For example, the lightweight nature of substrate 10 reduces the overall weight of the article, first and second layers 20 and 24 provide exterior surfaces which have metallic properties, and second layer 24 provides an exterior surface that may lend itself to reflective uses. Similarly, the combination of the different materials may provide unexpected results, such as better dampening and strength characteristics. It is contemplated that among many uses, two such uses are for EMI shielding and reflectivity/absorbance. In fact, specific embodiments of the present invention have been known to have an electrical resistivity of approximately 0.01 ohms. Clearly, those of ordinary skill in the art can envision many different uses for such an article. For example, it is desired to create dishes (e.g.—RF dishes) having a substrate similar to the above discussed substrate 10. The spray depositing steps discussed above allow such a dish to be created with the necessary properties for proper use.

Finally, numerous variations and combinations of the features discussed above can be employed without departing from the present invention. It is contemplated that the above discussed steps for forming article 1 can be modified in accordance with certain embodiments of the present invention. For example, spray processes in line with the above mentioned and incorporated patents and patent applications may be employed. Additionally, it is envisioned that various materials can be matched to provide similar CTEs and the necessary properties for the article desired.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of making an article comprising:

providing a substrate being at least partially constructed of a polymeric material, said substrate having an active surface;

spray depositing a first metal layer on said active surface by making at least one pass with at least one spray gun so that at least some of the metal is captured in small pockets formed in the polymeric material of said substrate; and spray depositing a second metal layer on said first metal layer, the second metal layer being selected from the group consisting of nickel, aluminum, stainless steel, silver, gold or copper, wherein the polymeric material of said substrate and the metal of said first metal layer have the same coefficient of thermal expansion.

2. The method according to claim 1, further comprising the step of roughening said active surface to form the small pockets prior to said spray depositing step.

3. The method according to claim 2, wherein said roughening step includes sandblasting.

4. The method according to claim 1, wherein the polymeric material comprises an epoxy and carbon/graphite fibers embedded therein, and the first metal layer comprises a nickel and iron composition having approximately 30-42% by weight nickel.

5. The method according to claim 4, wherein the polymeric material comprises an epoxy and carbon/graphite fibers embedded thereon, and the first metal layer comprises a nickel and iron composition having approximately 36% by weight nickel.

6. The method according to claim 1, wherein the first metal layer extends approximately between 0.040-0.060 inches above said active surface.

7. The method according to claim 1, wherein said substrate is cylindrically shaped.

8. The method according to claim 7, wherein said spraying step includes spraying the first metal layer around a circumference and at least partially along a length of said active surface.

9. The method according to claim 1, wherein said spraying step includes rotating said substrate.

10. A method of making an article comprising:

providing a substrate being at least partially constructed of a polymeric material, said substrate having an active surface and the polymeric material being an epoxy with carbon/graphite fibers embedded therein; and spray depositing a first metal layer on said active surface by making at least one pass with at least one spray gun so that at least some of the metal is captured in small pockets formed in the polymeric material of said substrate, the first metal layer including a nickel and iron composition having approximately 36% by weight nickel, wherein the polymeric material of said substrate and the metal of said first metal layer have the same coefficient of thermal expansion.

11. The method according to claim 10, further comprising the step of roughening said active surface to form the small pockets prior to said spray depositing step.

12. The method according to claim 11, wherein said roughening step includes sandblasting.

13. The method according to claim 10, further comprising the step of spray depositing a second metal layer on said first metal layer.

14. The method according to claim 13, wherein the second metal layer is selected from the group consisting of nickel, aluminum, stainless steel, silver, gold or copper.

15. The method according to claim 10, wherein the first metal layer extends approximately between 0.040-0.060 inches above said active surface.

16. The method according to claim 10, wherein said substrate is cylindrically shaped.

17. The method according to claim 16, wherein said spraying step includes spraying the first metal layer around a circumference and at least partially along a length of said active surface.

18. The method according to claim 10, wherein said spraying step includes rotating said substrate.

* * * * *